United States Patent [19]

Kyo

[11] 4,084,811

[45] Apr. 18, 1978

[54] HITTING DEVICE FOR MARTIAL ARTS

[76] Inventor: Han Cha Kyo, 7551 N. Bell, Chicago, Ill. 60645

[21] Appl. No.: 693,630

[22] Filed: Jun. 7, 1976

Related U.S. Application Data

[63] Continuation-in-part of Ser. No. 552,442, Feb. 24, 1975, which is a continuation of Ser. No. 520,976, Nov. 5, 1974, abandoned.

[51] Int. Cl.[2] ..... A63B 69/00

[52] U.S. Cl. ..... 272/76; 273/DIG. 25; 92/34; 272/DIG. 5

[58] Field of Search ..... 272/76, 77, DIG. 1, 272/DIG. 4; 273/102 R, 26 A, 1 R, 79 C, 55 R, 55 A; 128/DIG. 15; 92/34, 40, 41, 43; 29/454; 138/37, 43; 46/44, 146

[56] References Cited

U.S. PATENT DOCUMENTS

| | | | |
|---|---|---|---|
| 750,593 | 1/1904 | Cady | 272/76 |
| 930,818 | 8/1909 | Valentine | 272/76 |
| 1,044,987 | 11/1912 | Campbell | 272/76 |
| 3,032,345 | 5/1962 | Lemelson | 128/DIG. 15 |
| 3,162,440 | 12/1964 | Argiro | 272/76 |
| 3,638,350 | 2/1972 | Wiggens | 273/DIG. 25 |

FOREIGN PATENT DOCUMENTS

| | | | |
|---|---|---|---|
| 1,526,964 | 4/1968 | France | 272/76 |

*Primary Examiner*—Richard C. Pinkham
*Assistant Examiner*—T. Brown
*Attorney, Agent, or Firm*—Robert E. Browne

[57] ABSTRACT

A hitting device particularly adapted for use in the practice of martial arts, such as karate, which may be mounted on a vertical wall or post and carries a desired hitting surface. The bellows portion contracts when contacted axially to absorb the impact of the hitting force. Closable vents are provided in association with the bellows portion to allow for variation of the compressibility of the bellows, thereby varying the resistance to the hitting force by the hitting device. A force indicating assembly is also mounted on the hitting device for approximately indicating to a student the hitting force applied.

18 Claims, 4 Drawing Figures

HITTING DEVICE FOR MARTIAL ARTS

BACKGROUND OF THE INVENTION

This application is a continuation-in-part of application Ser. No. 552,442, filed Feb. 24, 1975, and now pending, which is, in turn, a continuation of application Ser. No. 520,976, filed Nov. 5, 1974, and now abandoned. The present invention relates to a novel device for use in martial arts practice which offers variable resistance to a hitting force and an indication of the force applied to it.

In learning and practicing the martial arts, including karate, it is necessary for the student to not only develop a toughness of his hands and feet, but to also develop the effectiveness of his technique and the force with which blows are delivered by his hands and feet. In the past, students have fastened rugs or packing to vertical supports, such as walls or posts, for use as a hitting pad during practice. The use of such improvised hitting pads has not proved satisfactory for various reasons. First, if the supporting member, such as a steel post, is too rigid, and the material forming the actual hitting surface is thin or not resilient, a beginning or experienced student may suffer fractures or other injuries to his hands or feet in delivering full force blows against such a surface. On the other hand, experience has shown that attachment of a rug or other hitting surface to a less rigid post will often result in fracture or collapse of the supporting member itself.

Some prior devices used containers packed with resilient, spongy material. These, of course, were not readily adjustable for use by students having varying degrees of experience and ability. Finally, the prior art provided no means by which a student had any indication of the force or effectiveness of the blow delivered to the hitting surface.

SUMMARY OF THE INVENTION

The present invention was developed to overcome the disadvantages of the prior art and provide a safe hitting apparatus which would be useful for not only experienced, but also inexperienced students of the martial arts.

The hitting device of the present invention includes a generally cylindrical, corrugated bellows portion or member that is normally expanded but is capable of contracting or compressing when contacted along its generally central axis. The opposite ends of the bellows portion are attached or integrally formed with a mounting base portion and a hitting base portion, respectively. The hitting base includes a surface upon which a variety of materials may be mounted to directly receive blows from a student's hand or foot. The mounting base includes means for securely mounting the entire hitting device on a vertical support, such as a wall or post.

The hollow interior of the bellows portion is closed by the mounting base and hitting base, with the exception of the plurality of spaced vents or openings designed to communicate the interior of the bellows portion with the atmosphere. Vent closure means are mounted on the hitting device for use in association with these vent openings for controlling the venting air from within the bellows portion in response to a hitting force exerted on the hitting surface. Two embodiments of the vent openings and associated closure means are shown in the drawings and described in the following paragraphs. These include plug-type closures directly insertable into the vent openings and a closure ring, which is angularly movable relative to the hitting device to block and close such openings, as desired. Such closure means reduce the venting capacity of the bellows portion, which increases the force required to obtain contraction. Thus, the hitting device may be made to accommodate the greater forces exerted by more skilled students.

The alternate embodiments herein also illustrate a number of means by which the hitting device may be mounted on a vertical support, such as by suction cups or link and loop fasteners.

The invention also includes a force indicating gauge, which has one end thereof mounted within the interior of the bellows portion to react to the compression of air therewithin and provide an indication of the amount of force exerted on the hitting device by the student.

Accordingly, it is an object of the present invention to provide a device which aids in the teaching and practice of martial arts, including karate.

Another object of the present invention is to provide a hitting device which is simple in construction and easy for all students of the martial arts to use.

A further object of the invention is to provide a hitting device for the practice of martial arts which allows for adjustment in resistance, according to the degree of skill of the student using it.

One further object of the present invention is to provide a hitting device for the practice of martial arts which may be readily mounted on any available vertical support.

Still another object of the present invention is to provide a hitting device for the practice of the martial arts which includes a gauge for indicating to a student the approximate effectiveness and force of the blow delivered to the hitting device.

These and other objects of the present invention will become apparent from the following detailed description of the invention taken in conjunction with the drawings, wherein.

DETAILED DESCRIPTION OF THE INVENTION

Figure 1:
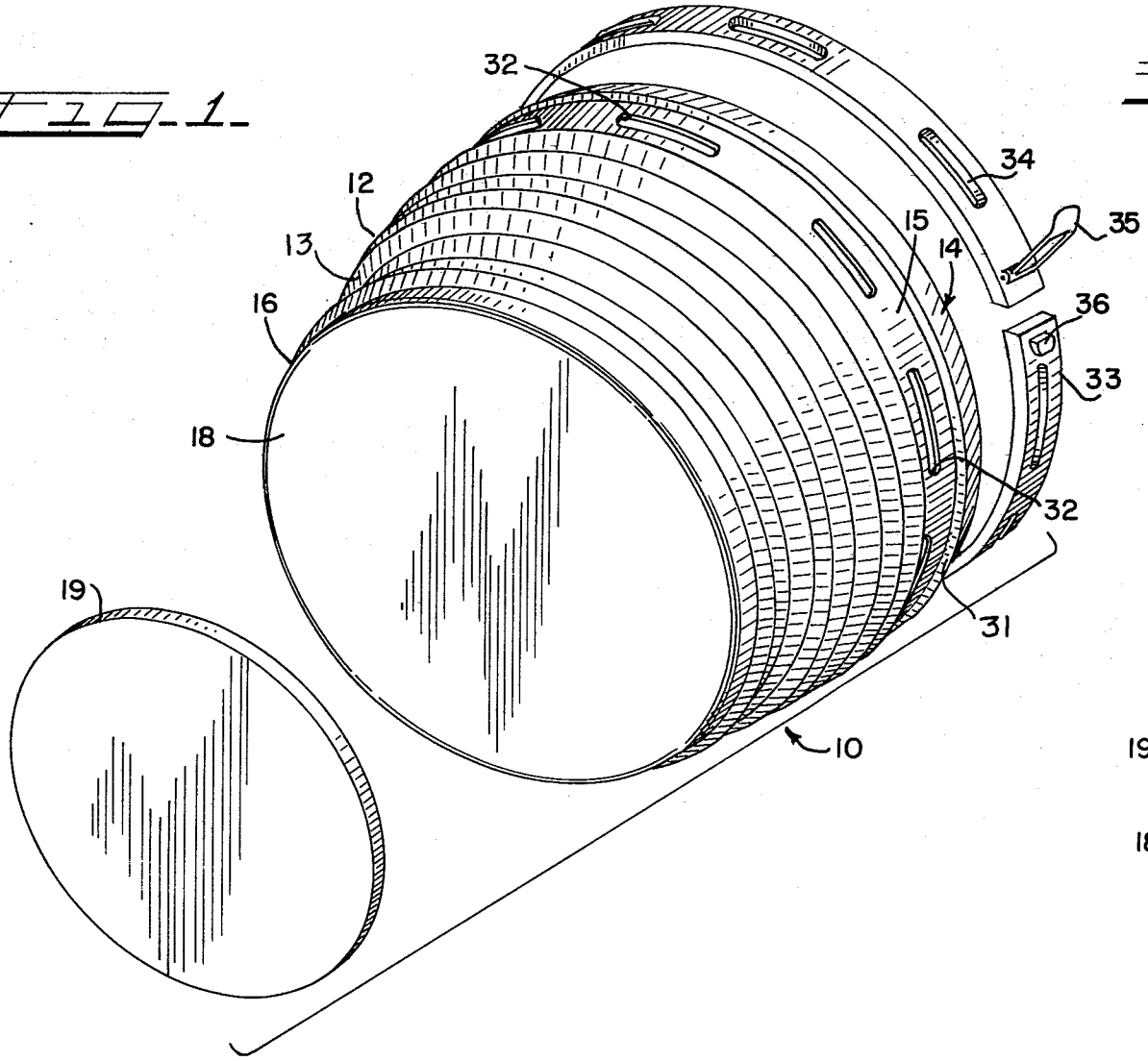
FIG. 1 is an exploded perspective view of the hitting device of the present invention.

Referring now to the drawings, and in particular to FIG. 1, the hitting device of the present invention is shown in general at 10. This hitting device 10 includes a central, hollow, generally frusto-conical bellows portion or member 12, which is preferably molded from a plastic material and has a series of axially spaced corrugations 13. Any suitable plastic material, such as polypropylene or polyethylene, may be used which may be molded with the desired corrugations 13, while retaining its inherent resiliency so that it tends to always return to its normal expanded condition, as shown in FIG. 1. The bellows portion 12 has a generally central axis and is open at its opposite ends. While the plastic material from which the bellows portion is formed normally has sufficient resilience and rigidity to maintain it in an expanded or erect condition, as shown in FIG. 1, an interior spring, which is not shown, may be provided to assist in returning it to an expanded condition, where materials such as described above are not used.

The open ends of the bellows portion 12 are closed by a mounting base portion 14, which is disposed over one end, and a hitting base portion 16, which is disposed over the opposite end. While it is preferred that both the mounting base 14 and the hitting base 16 be molded integrally with bellows portion 12, each could be formed separately and attached to the bellows portion by suitable means, such as gluing. Mounting base 14, as shown in FIG. 2, includes a generally flat surface having an upwardly extending mounting flange 15 disposed about its periphery, which joins base 14 to bellows portion 12.

The hitting base 16 includes a similar flat surface 18, which is generally parallel to the mounting base surface and which has a downwardly turned flange portion 17 disposed about its periphery, joined to the bellows portion 12. As shown in FIG. 2, the hitting base surface 18 supports a generally flat hitting pad 19, preferably formed of a spongy material. This pad may be permanently fixed to the surface 18, as an underbase for other hitting pads or fist pads which may be mounted over surface 18.

Figure 2:
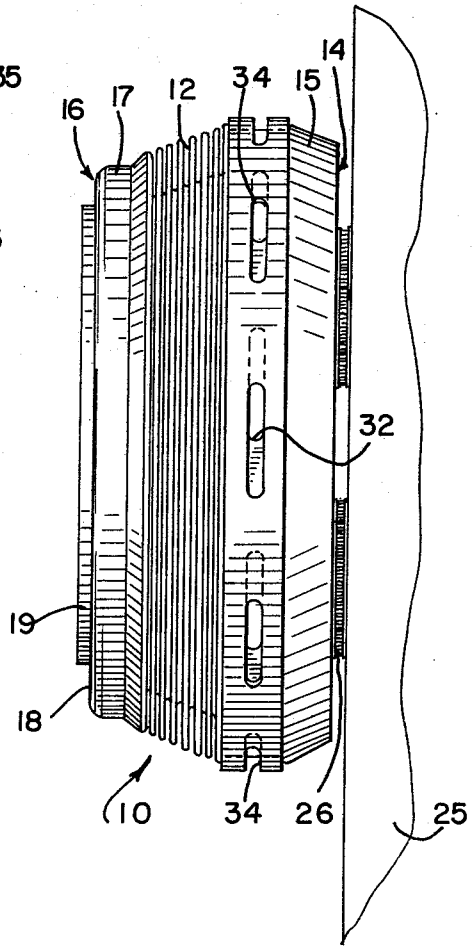
FIG. 2 is a side elevational view of the hitting device shown in FIG. 1 mounted on a wall and in a contracted state.

In the embodiment shown in FIGS. 1 and 2, the hitting device 10 is mounted on a wall or other vertical support 25 by means of complementary hook and loop-type fasteners 26. It is understood that either the hooks or loops will be mounted on the mounting base 14, while the corresponding portion of such fasteners, such as those normally sold under the trademark "VELCRO", will be mounted on the wall 25. Such fasteners allow the hitting device to be easily removable from its position on the wall or adjusted relative to the floor of the practice area to accommodate individual students.

As shown in FIGS. 1 and 2, flange 15 of mounting base 14 has a series of elongated vent slots or openings 32 formed in it in spaced relationship about its periphery. These slots 32 are formed within a narrow recess 31, which receives a vent closure ring 33 therewithin. Vent closure ring 33 has a series of similarly shaped openings or slots 34 formed therein, which correspond in size to openings 32 formed in flange 15. It is noted that slots 34 in closure ring 33 are spaced apart a distance approximately equal to the spacing of slots 32 on flange 15. Vent closure ring 33 may be moved angularly within recess 31 adjacent the surface of flange 15, relative to permanently fixed slots 32 to either align slots 34 with slots 32 or completely close slots 32 by moving a solid portion of the closure ring thereover.

To bring the ends of the ring 33 together to reduce the diameter of the ring and mount it securely within recess 31 such that the surface of the flange 15 is in contact with the inside surface of ring 33, the securing latch 35 may be engaged over boss 36. This will minimize the escape of air between the blocking surfaces of the ring 33 and the vents or openings 32. As explained above, and as shown in FIG. 2, the variable positioning of ring 33 with respect to vents 32, determines the rate of contractibility of the entire bellows member under the influence of a hitting force because, in effect, it reduces the orifice through which air captured within the interior of the hitting device is normally evacuated in response to the force of an axial blow. As the size of the escape vent or orifice is reduced, the bellows member becomes more difficult to compress and, therefore, more resistant to equal hitting forces. As the student becomes more skilled in the art and his blows become more effective and forceful, he will wish to reduce the contractibility of the bellows by closing the vents through adjustment of the enclosure ring 33 to obtain more resistance to his blows. This will not only harden his hands and feet, but will improve his hitting technique and force.

A series of coding colors may be placed on the hitting device above one or more of the slots 32 to indicate to the student the varying degrees of difficulty of contractibility or compressibility as the solid portions of closure ring 33 are moved further over the vent openings 32. For example, substantially full closure of the openings 32 would present a degree of difficulty commensurate with the skill of an advanced student and could be obtained by aligning corresponding black vertical lines positioned on both the bellows member 12 and the closure ring 33.

Figure 4:
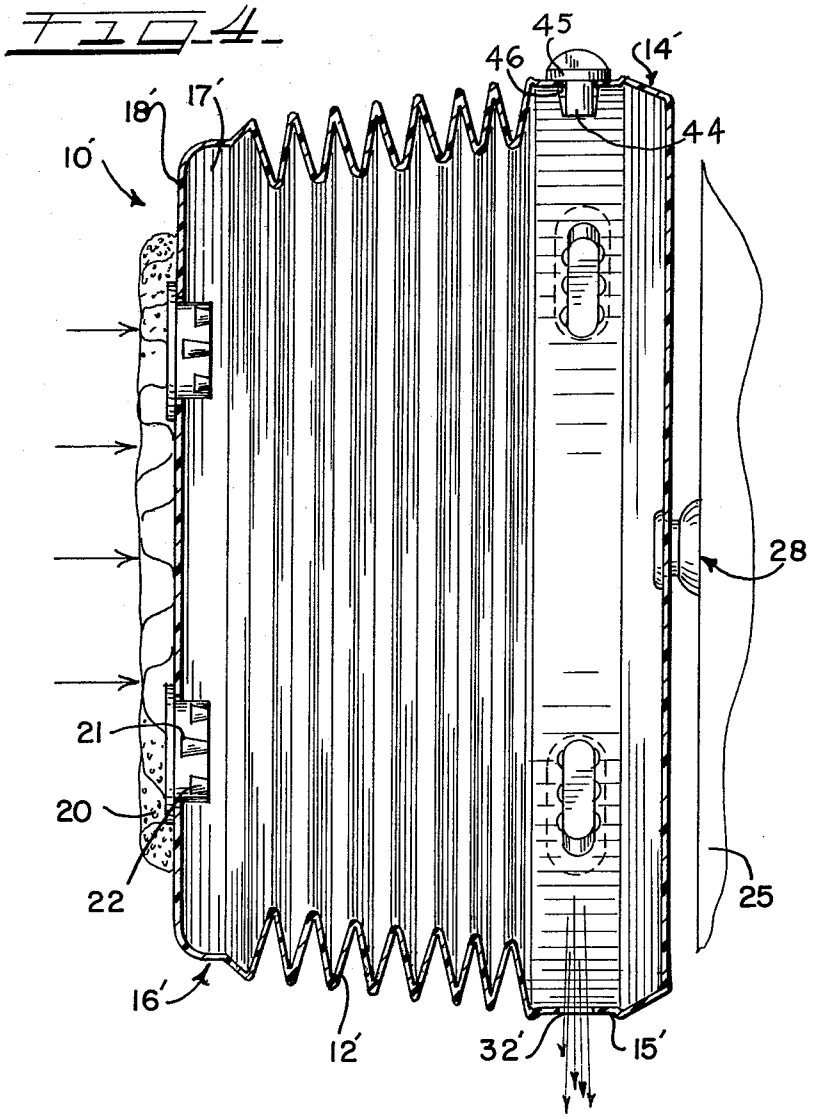
Figure 3:
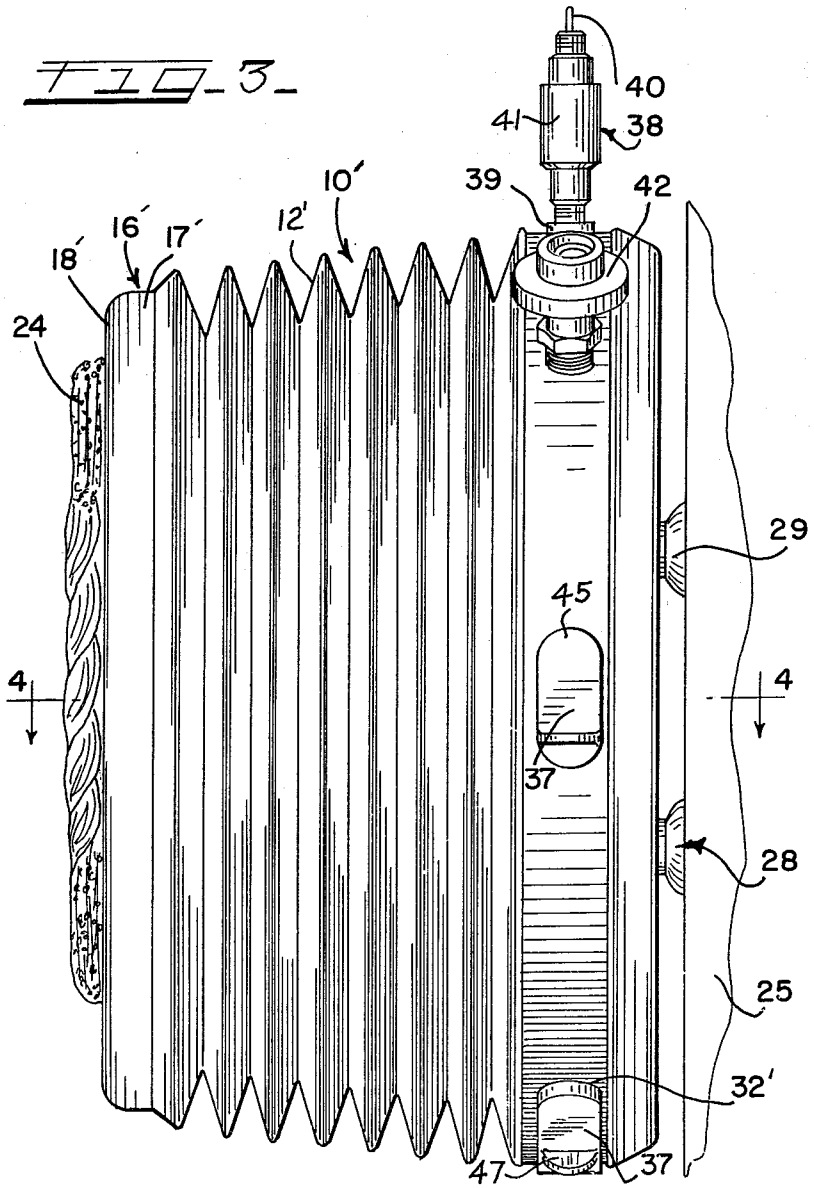
FIG. 3 is an elevational view of the hitting device of the present invention illustrating a second, slightly modified embodiment; and, FIG. 4 is a cross-sectional elevational view of the embodiment of the hitting device shown in FIG. 3, taken generally along line 4—4 of FIG. 3.

In the second, slightly modified embodiment 10′ of the hitting device of the present application, shown in FIGS. 3 and 4, a different, but equally effective, type of vent closure means is used. In this embodiment 10′, parts similar to those discussed above are indicated by prime numerals. Hitting device 10′ includes a bellows portion 12′, a mounting base 14′ and a hitting base 16′. While the embodiment shown at 10′ could use the same type of mounting means or fastener as that shown at 26 in the first embodiment, FIG. 3 illustrates a second suitable mounting means 28, which consists of suction cups 29, having one end attached to the hitting base 14′ and a cup portion mounted in a conventional manner on a supporting wall or surface 25′. This embodiment also illustrates an alternative type of closure means which includes a plurality of elongated vent plugs 37, which may be inserted into vent openings 32′, formed in the flange portion 15′ of hitting base 14′.

The vent plugs 37 are preferably formed from a deformable material, such as rubber, and have a lower portion 44, having a dimension similar to that of opening 32′, and a cap portion 45 extending horizontally beyond the periphery of lower portion 44 to form a top flange which will extend beyond the margins of openings 32′. Lower portion 44 also preferably has a number of outwardly extending ridges 46, which are spaced from top portion 45 a sufficient distance so that after the plug 37 is inserted in the slot 32′, ridges 46 will engage the inside edges of the material forming slots 32′ to maintain the plugs 37 within the slot 32′. A lifting tab 47 is provided to aid in removing the tightly fitting plugs from the slots 32′.

As with the closure ring 33, the number of plugs which are inserted into the slots formed around flange 15′ of the hitting base 14′ will determine the resistance of bellows 12′ to contraction. It is understood that neither the closure ring 33, nor the plugs 37 are intended to provide absolute air-tight sealing around each slot 32. Thus, when a student of the highest degree of skill closes all vents, there will still be sufficient escape of air to allow some contractibility of the hitting device. For a student of this aptitude, however, a one-way valve 42 is also provided which will prevent the flow of air out of the interior of the hitting device, but will allow air to re-enter the interior after compression to assist the bellows in returning to its normal, expanded position. This is necessary because the atmospheric pressure forcing air back into the interior of bellows 12′ is significantly less than the force directing the air out of the bellows. Thus, some means should be provided, when all vents 32' are closed, to assist in directing air back to the interior of the hitting device 10'.

FIG. 3 also shows a force indicating means 38, which may be mounted on the hitting device 10' to indicate to a student the approximate degree of force or effectiveness of the blow which is delivered to the hitting surface. Force indicating means 38 consists of a gauge, similar to a conventional tire gauge, having a body 41, a valve end 39, and a movable indicator 40. The force indicator 38 is mounted on the flange 15' of the hitting device so that the open valve end 39 terminates within the interior of the hitting device, as is conventional in such force indicating means. Gauge 38 responds to air pressure exerted on the valve end 39, which, in turn, causes indicator 40 to move outward in proportion to the degree of pressure exerted. Indicator 40 may be calibrated to correspond to the force of the blow delivered. This gauge can also be used in connection with the embodiment of the present invention illustrated in FIGS. 1 and 2 by mounting the gauge around the lower part of the flange portion 15 or at any other suitable location.

FIGS. 3 and 4 also illustrate various types of hitting pads which may be mounted over the hitting base surface 18. Obviously, beginning students of the martial arts may desire a pad formed of a spongy-type material so that they can strike the pad without causing damage to hands or feet. On the other hand, advanced students generally desire a tougher material for the purpose of toughening the skin. Fist pad 20, shown in FIG. 4, illustrates a jute-type of hitting surface, while fist pad 24, shown in FIG. 3, is a straw mat. In addition, a combination of such surfaces may be developed. For example, a hitting pad could be formed of a jute base to which is glued a cross layer of straw, which is stitched to a leather hitting surface. These various surfaces have been found, by experience, to provide suitable results for various levels of learning. Each of these pads, whether of a single material or a layered type of pad, may be easily mounted on hitting base 16' through openings 22 formed in the top hitting surface 18', into which are inserted holding plugs 21, having a base portion mounted on the bottom side of the fist pad 20. These holding plugs 21 are similar in configuration and construction to the vent plugs 37 described above. In this manner, hitting pads may be interchanged as desired on the same hitting device. As an alternative means of mounting such fist pads on hitting base 16 or 16', the mat portion may be attached to a cloth base or the like, having an elastic band which may be fitted over the entire hitting base, including the flange 17 or 17'. Other mounting means may be used as would be suitable to accomplish the desired result of interchangeability and will maintain the fist pad on the hitting base during use.

Likewise, it is clear that other means of mounting the disclosed hitting device to the supporting wall or beam, such as affixing it by means of permanent mounting plates, could be used, if desired. Also, various methods of obtaining closure of the vents 32 and 32', such as by sliding lids or the like riding in rails associated with each vent 32, could be used, so long as they permit adjustability of the venting capacity of the hitting device. While the embodiments illustrated above are believed to be simpler and more inexpensive in manufacture and therefore preferred, some of the above referred to alternatives are illustrated in application Ser. No. 552,442, filed Feb. 24, 1975, and referred to above. The disclosure of that application is specifically incorporated herein by reference thereto.

Although the illustrated embodiments show use of a molded plastic material to form the body of the invention, other suitable materials may be utilized. Likewise, although the present invention is shown in a cylindrical form, other configurations could be used effectively. Upon consideration of the foregoing, therefore, it will become apparent to one skilled in the art that various modifications may be made in the subject invention without departing from the spirit of the invention embodied herein. Therefore, only such limitations should be imposed as are indicated by the spirit and scope of the following claims.

I claim:

1. A hitting device particularly adapted for practicing martial arts, such as karate, including a central bellows portion which is contractible in response to an axially directed force, a hitting portion disposed at one end of said bellows portion and having a surface to receive a blow exerting such an axially directed force, a mounting portion disposed at an opposite end of said bellows portion by which said hitting device may be mounted on a desired support, and vent means associated with said hitting device and adjustable for venting air in a controlled manner from an interior of said hitting device during contraction of said bellows portion, said vent means including a plurality of openings formed in said hitting device to communicate said interior of said hitting device with the atmosphere, and closure means for use in association with said openings to control the rate at which air from said interior of said hitting device is vented through said openings to said atmosphere to thereby determine the contractibility of said bellows portion in respose to said axial force.

2. The hitting device of claim 1 wherein said mounting portion includes a generally flat mounting surface having a generally upstanding flange disposed about the periphery thereof, connected to said bellows portion, said vent openings being formed in said mounting base flange in spaced relationship about the periphery thereof, said vent closure means including a plurality of blocking plugs similar in configuration to the shape of said vent openings, said blocking plugs being disposed in selected ones of said vent openings to prevent the passage of air therethrough and thereby adjust the degree of contractibility of said bellows portion of said hitting device.

3. The hitting device of claim 1 wherein said mounting portion includes a generally flat mounting surface having a generally upstanding flange disposed about the periphery thereof connected to said bellows portion of said hitting device, said vent openings being formed in said mounting base flange in spaced relationship about the periphery thereof, and said vent closure means including a peripheral member corresponding in configuration to and having an interior dimension slightly larger than the exterior dimension of said mounting flange, said peripheral blocking member being disposed about said mounting flange for sliding movement relative thereto, a pluraity of control openings being formed in said peripheral blocking member in spaced relationship therearound, substantially corresponding to the spacing of said vent openings formed in said mounting base flange, said peripheral blocking member being movable relative to said mounting base flange and said vent openings formed in said mounting base flange as desired to adjust and control the passage of air through said vent openings, between said interior of said hitting device and the atmosphere, and thereby determine the degree of contractibility of said bellows portion of said hitting device.

4. The hitting device of claim 1 wherein said bellows portion is formed in a generally cylindrical, frusto-conical configuration having a series of vertically spaced corrugations formed therearound.

5. The hitting device of claim 1 wherein said bellows portion, said mounting base portion and said hitting base portion are integrally molded from a lightweight, generally resilient plastic material.

6. The hitting device of claim 1 wherein said mounting base portion includes a generally flat surface which carries a mounting means for removably mounting said hitting device in a desired position on a support.

7. The hitting device of claim 6 wherein said mounting means carried on said flat surface of said mounting base portion includes a plurality of suction means attached to said surface and outwardly directed therefrom to engage a corresponding flat surface of said support.

8. The hitting device of claim 6 wherein said mounting means includes a plurality of hook fasteners which engage a plurality of corresponding loop fasteners mounted on said support to attach said hitting device to said support.

9. The hitting device of claim 1 wherein said hitting portion includes a generally flat hitting surface, said hitting surface supporting a hitting pad of desired thickness, resiliency and texture adjacent said hitting surface.

10. The hitting device of claim 9 wherein said hitting surface has a plurality of holding openings formed therein and said hitting pad has a plurality of corresponding holding plugs attached to one side thereof, said holding plugs being insertable into said holding openings to removably mount said hitting pad on said hitting surface.

11. The hitting device of claim 1 including force indicating means mounted on said hitting device, at least a portion of said force indicating means being disposed within said interior of said hitting device, said force indicating means being responsive to sudden changes in air pressure within said hitting device to indicate the magnitude of said force applied to said bellows portion.

12. The hitting device of claim 11 wherein said force indicating means includes a body, a valve end, and a movable indicator, said body being mounted through a wall of said bellows portion such that said valve end is disposed within said interior of said bellows portion while said movable indicator is visible to one using said hitting device.

13. In a hitting device particularly adapted for practicing martial arts, such as karate, including a hollow central bellows portion which is contractible in response to an axially directed force, a hitting portion disposed at one end of said bellows portion and having a surface to receive a blow exerting such an axially directed force, a mounting portion disposed at an opposite end of said bellows portion by which said hitting device may be mounted on a desired support, and means associated with said hitting device and allowing air to be evacuated from an interior of said hitting device to permit contraction of said bellows portion, the improvement comprising adjustable vent means associated with said hitting device having a plurality of openings formed in said hitting device to communicate said interior of said hitting device with the atmosphere, and closure means for use in association with said openings to control the rate at which air from said interior of said hitting device is vented through said openings to said atmosphere to thereby determine the contractibility of said bellows portion in response to said axial force.

14. The improvement set forth in claim 13 wherein said mounting portion includes a generally flat mounting surface having a generally upstanding flange disposed about the periphery thereof, connected to said bellows portion, said vent openings being formed in said mounting base flange in spaced relationship about the periphery thereof, said vent closure means including a plurality of blocking plugs similar in configuration to the shape of said vent openings, said blocking plugs being disposed in selected ones of said vent openings to prevent the passage of air therethrough and thereby adjust the degree of contractibility of said bellows portion of said hitting device.

15. The improvement set forth in claim 13 wherein said mounting portion includes a generally flat mounting surface having a generally upstanding flange disposed about the periphery thereof connected to said bellows portion of said hitting device, said vent openings being formed in said mounting base flange in spaced relationship about the periphery thereof, and said vent closure means including a peripheral member corresponding in configuration to and having an interior dimension slightly larger than the exterior dimension of said mounting flange, said peripheral blocking member being disposed about said mounting flange for sliding movement relative thereto, a plurality of control openings being formed in said peripheral blocking member in spaced relationship therearound substantially corresponding to the spacing of said vent openings formed in said mounting base flange, said peripheral blocking member being movable relative to said mounting base flange and said vent openings formed in said mounting base flange as desired to adjust and control the passage of air through said vent openings, between said interior of said hitting device and the atmosphere and thereby determine the degree of contractibility of said bellows portion of said hitting device.

16. The improvement set forth in claim 13 wherein said bellows portion is formed in a generally cylindrical, frusto-conical configuration having a series of vertically spaced corrugations formed therearound.

17. The improvement set forth in claim 13 wherein said bellows portion, said mounting base portion and said hitting base portion are integrally molded from a lightweight, generally resilient plastic material.

18. The hitting device of claim 13 including force indicating means mounted on said hitting device, at least a portion of said force indicating means being disposed within said interior of said hitting device, said force indicating means being responsive to sudden changes in air pressure within said hitting device to indicate the magnitude of said force applied to said bellows portion.

* * * * *